US006051305A

United States Patent [19]

Hsu

[11] Patent Number: 6,051,305

[45] **Date of Patent: *Apr. 18, 2000**

[54] PRINTED POLYMERIC FILM AND PROCESS FOR MAKING SAME

[75] Inventor: Chien-Lu Hsu, Greer, S.C.

[73] Assignee: Cryovac, Inc., Duncan, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/787,561

[22] Filed: Jan. 22, 1997

[51] Int. Cl.[7] ..... B41M 5/00

[52] U.S. Cl. ..... 428/195; 156/235; 428/500; 428/522; 430/14; 430/15; 430/22; 430/47; 430/114; 430/358

[58] Field of Search ..... 430/14, 15, 22, 430/358, 47, 114; 428/195, 204, 411.1, 913, 914, 500, 522; 156/235

[56] References Cited

U.S. PATENT DOCUMENTS

| | | | |
|---|---|---|---|
| 4,794,651 | 12/1988 | Landa et al. | 430/110 |
| 4,842,974 | 6/1989 | Landa et al. | 430/137 |
| 4,860,924 | 8/1989 | Simms et al. | 222/56 |
| 4,974,027 | 11/1990 | Landa et al. | 355/256 |
| 4,984,025 | 1/1991 | Landa et al. | 355/274 |
| 4,999,677 | 3/1991 | Landa et al. | 355/273 |
| 5,047,306 | 9/1991 | Almog | 430/115 |
| 5,047,307 | 9/1991 | Landa et al. | 430/17 |
| 5,055,371 | 10/1991 | Lee et al. | 430/126 |
| 5,155,001 | 10/1992 | Landa et al. | 430/115 |
| 5,192,638 | 3/1993 | Landa et al. | 430/137 |
| 5,208,130 | 5/1993 | Almog et al. | 430/115 |
| 5,225,306 | 7/1993 | Almog et al. | 430/115 |
| 5,234,782 | 8/1993 | Aslam et al. | 430/99 |
| 5,264,313 | 11/1993 | Landa et al. | 430/137 |
| 5,266,435 | 11/1993 | Almog | 430/115 |
| 5,276,492 | 1/1994 | Landa et al. | 355/277 |
| 5,286,593 | 2/1994 | Landa et al. | 430/115 |
| 5,289,245 | 2/1994 | Menjo | 355/284 |
| 5,300,390 | 4/1994 | Landa et al. | 430/115 |
| 5,335,054 | 8/1994 | Landa et al. | 355/279 |
| 5,346,796 | 9/1994 | Almog | 430/115 |
| 5,407,771 | 4/1995 | Landa et al. | 430/109 |
| 5,426,491 | 6/1995 | Landa et al. | 355/256 |
| 5,437,913 | 8/1995 | Asaka et al. | 428/195 |
| 5,508,790 | 4/1996 | Belinkov et al. | 355/211 |
| 5,532,805 | 7/1996 | Landa | 355/256 |
| 5,552,875 | 9/1996 | Sagiv et al. | 355/319 |
| 5,554,476 | 9/1996 | Landa et al. | 430/106 |
| 5,555,185 | 9/1996 | Landa | 355/256 |
| 5,558,970 | 9/1996 | Landa et al. | 430/126 |
| 5,827,627 | 10/1998 | Cleckner et al. | 430/18 |

FOREIGN PATENT DOCUMENTS

| | | | |
|---|---|---|---|
| 0 433 950 A2 | 12/1990 | European Pat. Off. | 428/195 |
| 0 657 782 A1 | 12/1993 | European Pat. Off. | 428/195 |
| 0 729 074 A1 | 2/1996 | European Pat. Off. | 428/195 |
| WO 96/31808 | 10/1996 | WIPO . | |
| WO 96/27053 | 7/1997 | WIPO | 428/195 |

OTHER PUBLICATIONS

Converting Magazine®, Oct. 1996, Technical Report, Revealing the mystery behind digital printing, pp. 76–80.

Seybold Publications, Report on Publishing Systems, vol. 22, No. 20, Jul. 12, 1993, Indigo's E–Print: New Generation of Offset Color Printing, pp. 1–8.

Seybold Publications, Report on Publishing Systems, vol. 24, No. 13, Mar. 13, 1995, Indigo Expands Digital Press Line To Packaging: Enhances E–Print 1000, 11 Pages.

*Primary Examiner*—Bruce H. Hess

[57] ABSTRACT

A printed film includes a substrate film with a surface polymeric layer that includes a thermoplastic polymer having a melting point of no more than about 130° C. and, on a surface of the film, a printed image in the form of a polymeric film. The substrate film can be printed without chemically and/or oxidatively priming the surface to be printed and exhibits superior retention of the image after undergoing heat treatment.

20 Claims, No Drawings

PRINTED POLYMERIC FILM AND PROCESS FOR MAKING SAME

BACKGROUND INFORMATION

1. Field of the Invention

This invention relates to printed polymeric films, more particularly to polymeric films with a polymeric film image printed thereon.

2. Background of the Invention

Short-run printing techniques allow printers and their customers to make a nearly unlimited number of changes to a given printed image and to do so in an essentially instantaneous manner. Thus, such techniques are ideal for customized and/or specialty printing (i.e., where a limited number of pages with a given design, image, text, etc., are to be printed), especially where more than one color is to be included. One such technique is digital printing embodied by, for example, the DCP-1 web press (Xeikon; Mortsel, Belgium) and the E-Print™ 1000 digital offset press (Indigo N.V.; Maastricht, The Netherlands).

Recently, short-run printing methods have been adapted for use with flexible packaging materials, particularly polymeric films. Such films typically are in the form of continuous webs rather than discrete sheets. New digital presses designed specifically for use with polymeric films were developed. One example of such a press is the Omnius™ color press (Indigo N.V.).

Despite the fact that such film printing presses have been developed, the surface layers of such films (where printing is to occur) have had to be primed prior to printing. For example, one reviewer of this technology has stated, "The Indigo system has been printed on various films, but to provide good adhesion, a surface primer or film-surface modification is necessary." Podhajny, "Technical Report: Revealing the mystery behind digital printing," Converting Magazine, October 1996 at 78. Although surface modification techniques (e.g., flame or corona treatment, buffing, etc.) can be used to prepare the surface of a polymeric film for printing, application of a chemical primer coating more commonly is used.

Polymeric film substrates commonly used with digital color presses such as, for example, the Omnius™ color press, include polyesters (3M; St. Paul, Minn.) and oriented polypropylenes (Mobil Chemical Co.; Macedon, N.Y.). Both of these, as well as other commercially available films for use with such printers, require the application of a primer prior to printing, however.

To further complicate the issue, many polymeric films are heat treated (e.g., heat shrunk) prior to end use. Such treatment can occur in a hot water (e.g., 85° C. or higher) bath, a hot air (e.g., about 140° C. or higher) tunnel, or a steam tunnel. Unfortunately, heating of printed polymeric films often causes the printed image to delaminate from the film. This can be due to the effect of entrained solvents softening the ink system, thereby lowering the adherence of the ink to the film. This lowered adherence renders the printed film susceptible to abrasion and/or transfer of the printed image to another surface. In severe cases, the ink can lift entirely away from the substrate.

Use of an unprimed or untreated polymeric film substrate, particularly one which is useful for the packaging of food and which can maintain good adhesion with the image even when heated, in a color printing process has not been described previously.

SUMMARY OF THE INVENTION

Briefly, the present invention provides a printed polymeric film that includes a substrate film including a surface polymeric layer and, on the surface polymeric layer, a printed image in the form of a polymeric film. The surface polymeric layer includes a thermoplastic polymer having a melting point of no more than about 130° C. and is chemically and oxidatively unprimed.

In another aspect, the present invention provides a printed polymeric film consisting essentially of a substrate film including a surface polymeric layer and, on the surface polymeric layer, a printed image in the form of a polymeric film. The surface polymeric layer includes a thermoplastic polymer having a melting point of no more than about 130° C.

In a further aspect, the present invention provides a process of making a printed polymeric film. The process includes the step of transferring a polymeric film image from a heated plate to a surface of a substrate film. The substrate film includes a surface polymeric layer which includes a thermoplastic polymer having a melting point of no more than about 130° C. The surface polymeric layer is chemically and oxidatively unprimed. A printed polymeric film made by this process also is provided.

The substrate film of the present invention can include more than one polymeric layer, i.e., can be a multilayer film. Also, the film can be supported on a sheet material such as, for example, another polymeric film.

The film of the present invention can, if desired, be printed on both of its primary surfaces. The printing of the second surface can be performed according to the process of the present invention as long as the second surface layer also includes one or more thermoplastic polymers that have melting points of no more than about 130° C., preferably no more than about 125° C. Where the second surface layer does or does not include such a polymer, conventional printing processes also can be used.

The thermoplastic polymer(s) of the surface polymeric layer can include a polymer that comprises mer units derived from ethylene (such as, for example, ethylene/α-olefin copolymers, polyethylene homopolymer, low density polyethylene (LDPE), linear low density polyethylene (LLDPE), very low density polyethylene (VLDPE), ultra low density polyethylene (ULDPE), ethylene/cyclic olefin copolymers, ionomers, ethylene/vinyl acetate copolymers, ethylene/(meth)acrylate copolymers, and ethylene/(meth)acrylic acid copolymers); a polymer that comprises mer units derived from propylene (such as, for example, syndiotactic polypropylene and propylene/α-olefin copolymers); a polymer that comprises mer units derived from styrene (such as, for example, polystyrene, styrene block copolymers, and styrene/α-olefin copolymers); copolyamides; copolyesters; polybutadiene; poly(vinyl chloride); polybutene, and the like.

Conventional wisdom regarding the adhesion of inks to substrates has been that surface tension of the substrate plays a critical, if not primary, role in determining how well an ink adheres to a given substrate. However, the work leading to the present invention has shown that the melting point (or some other Theological property, such as softening point) of the polymer(s) making up the surface layer (i.e., the layer to be printed) of the substrate film play a critical role. Use of polymers having melting points (or softening points) of no more than about 130° C., preferably no more than about 125° C., allows a polymeric film to be printed without first oxidatively modifying the film (such as by, for example, flame or corona treatment) or chemically priming the film (such as by, for example, the application of a priming layer). Advantageously, the surface layer of the polymeric film also need not be physically altered (e.g., buffed).

Printed polymeric films are used extensively in the packaging industry. Areas where printed films (or packages made therefrom) find utility include the packaging of food items such as cut and uncut produce, cuts of red meat, poultry, smoked and processed meats, cheeses, baked goods, etc.; the packaging of prepared food and drink mixes; the packaging of pet foods; clarity display films; collating packaging; theft resistant packaging; and the like.

The following definitions apply hereinthroughout unless a contrary intention is expressly indicated:

"polymer" means the product of a polymerization of one or more monomers and/or oligomers and is inclusive of homopolymers, copolymers, terpolymers, etc.;

"copolymer" means a polymer formed by the polymerization of at least two different monomers and is inclusive of terpolymer;

"heterogeneous", as relating to polymers, means having relatively wide variation in molecular weight and composition distributions, such as can be obtained through the use of conventional multi-site (e.g., Ziegler Natta) catalysts;

"homogeneous", as relating to polymers, means having relatively narrow molecular weight and composition distributions, such as can be obtained through the use of single-site (e.g., metallocene or late transition metal) catalysts;

"softening point" (or "Vicat softening point"), as relating to a thermoplastic polymer, is the onset temperature of penetration of that polymer, heated under load, according to the procedure set forth in ASTM 1525, which procedure is incorporated herein by reference;

"polyolefin" means a polymer of one or more alkenes which can be linear, branched, cyclic, aliphatic, aromatic, substituted, or unsubstituted;

"(meth)acrylic acid" means acrylic acid or methacrylic acid;

"(meth)acrylate" means an ester of (meth)acrylic acid;

"ionomer" means a metal salt of a polymer that includes mer units derived from ethylene and (meth)acrylic acid;

"sealant layer" means an film layer involved in the sealing of the film to itself (e.g., the inner layer in a fin-type seal and the outer layer in a lap-type seal) or another layer (while keeping in mind that only about the outer 10 to 25 $\mu$m of a film is involved in the sealing of a film);

"tie layer" means any inner layer having the primary purpose of adhering two layers to one another;

"laminate" means to bond together two or more layers of film (e.g., with adhesives or application of heat and pressure);

"primer" means a coating, usually polymeric, applied to the surface of a substrate to enhance the adhesion of ink to the substrate;

"chemically unprimed", as relating to films, means no separate primer layer has been applied to the film; and "oxidatively unprimed", as relating to films, means no alteration of the surface of the film by a process that oxidizes the surface thereof.

DETAILED DESCRIPTION OF ILLUSTRATIVE EMBODIMENTS

The present invention involves the discovery that certain polymeric film substrates can be printed (e.g., by electrostatic means) without the surface thereof first being primed in some manner. Specifically, films having surface layers in which at least one polymer that makes up that layer has a melting point of no more than about 130° C., preferably no more than about 125° C., can be printed without the need for preliminary surface modification. Preferably, all polymers that make up the surface layer to be printed have melting points of no more than about 130° C., preferably no more than about 125° C.

As just mentioned, the present invention relates directly to polymeric films. Although the present invention does not relate directly to electrostatic (also known as electrophotographic) printing, a brief overview of the principles and methods involved in that technique are discussed herein for the convenience of the reader.

In electrostatic printing, a photoconductive imaging plate (often in the form of a cylinder) is provided with a uniform electrostatic charge, typically by moving the plate past a charge corona. This charged plate is exposed to an optical image. This image selectively discharges the imaging plate so as to form a latent electrostatic image.

The image plate bearing the latent electrostatic image is exposed to a toner composition. The toner composition normally is fed (from a separately stored container by, for example, a compressed air mechanism) onto the image plate very near to the portion bearing the latent electrostatic image. The toner composition deposits on the print portions of the latent image in a pattern corresponding to the original image.

Typically, the toner composition includes a nonpolar liquid, a pigment, thermoplastic polymer particles, and a charge directing compound. Some toner compositions further include a compound that stabilizes the electrical properties of the charge directing compound. (Further description of such toner compositions is provided infra.) Unused toner can be recycled for further use.

The pigment-containing pattern is transferred from the image plate to a second plate, commonly referred to as the "blanket". The pattern preferentially transfers to the blanket because the negatively charged pigment is repelled from the highly negatively charged image plate to the less negatively charged blanket. Where the image plate and blanket each are in the form of a cylinder, transfer can be accomplished by rotating the image cylinder such that the pigment-containing pattern contacts the blanket cylinder.

The blanket is held at an elevated temperature. Commonly, this temperature is in the range of about 120° to about 135° C. The elevated temperature assists in coalescing the toner. Specifically, the thermoplastic polymer particles of the toner composition, which are insoluble in the nonpolar liquid at ambient and slightly elevated temperatures but which become soluble therein at temperatures above about 50° C., begin to fuse when the toner composition is heated above its coalescence temperature. Commonly, this is about 70° C. As this fusion (or coalescence) proceeds, pigment in the pattern of the aforementioned image becomes entrapped in the polymer film that forms.

Where single-color printing is desired, the image can be transferred directly to the polymeric film at this point. However, in multicolor printing, the polymer film image remains on the blanket in a relatively tacky state while further processing occurs. Specifically, the image plate again is taken through the above-described steps and a different color toner is applied thereto. When the new latent image is formed, the second (or subsequent) image is transferred from the image plate to the blanket in the same manner as before. The second (or subsequent) image is in registry with the first. The process is repeated until all colors have been transferred to the blanket.

Once all the individual color images have been transferred to the blanket, the overall image (i.e., the polymer film that has formed on the blanket) is transferred to the polymeric film. Where the blanket is in the form of a cylinder, this is accomplished merely by rolling the cylinder so that the polymer film image is brought into contact with the polymeric film, which is held nearby or in contact with the blanket cylinder. To assist in supporting the polymeric film during this process, an impression cylinder can be located just below the blanket cylinder such that the two cylinders form a nip through which the polymeric film passes.

The polymer film image preferentially transfers from the blanket to the polymeric film, perhaps due to thermal bonding between the image and the thermoplastic polymer. (If this is the case, such bonding potentially can be enhanced by selecting a film wherein the thermoplastic polymer(s) of the surface layer is/are chemically compatible with or similar to the polymer of the film image.) In this transfer process, the polymer film image essentially is laminated to the receiving surface of the polymeric film. The thickness of the polymer film image is on the order of a micron.

After the polymeric film image has been transferred to the surface of the polymeric film, the image quickly cools and sets. The polymeric film automatically is advanced so that another segment of the film can be brought into the nip and readied for another image transfer from the blanket cylinder.

Typically, the optical image to which the image plate is exposed is digitized. For example, images digitally stored on a recording medium (e.g., the hard drive of a computer, a floppy disk, magnetic tape, an optical disk, etc.) can be loaded into an image memory unit. This unit processes the information and drives a laser imager which creates the optical image to which the image plate is exposed. The process of retrieving, processing, and transferring the optical image typically is controlled by means of a computer system such as, for example, a Sun™ workstation.

The entire process just described can be performed by, for example, an Omnius™ color press. Further details regarding the design and/or operation of this press (or of electrostatic imaging in general) are believed to be given in, for example, the following U.S. patents, the teachings of which are incorporated herein by reference:

| | |
|---|---|
| 5,558,970 (Landa et al.) | 5,555,185 (Landa) |
| 5,552,875 (Sagiv et al.) | 5,532,805 (Landa) |
| 5,508,790 (Belinkov et al.) | 5,426,491 (Landa et al.) |
| 5,335,054 (Landa et al.) | 5,276,492 (Landa et al.) |
| 5,155,001 (Landa et al.) | 4,999,677 (Landa et al.) |
| 4,984,025 (Landa et al.) | 4,974,027 (Landa et al.) |
| 4,860,924 (Simms et al.) | |

Toner compositions preferred for use in the present invention are classified generally as liquid toners, although the use of dry toners also is contemplated. These toners include a nonpolar liquid, thermoplastic polymer particles, a pigment, and a charge directing compound. (Dry toners have each of the foregoing except for the nonpolar liquid component.) Some also can include a compound that stabilizes the electrical properties of the charge directing compound.

The nonpolar liquid of the toner generally has an electrical resistivity of at least $10^9$ Ω·cm and a dielectric constant less than about 3.0. Commonly used nonpolar liquids include aliphatic hydrocarbons and light mineral oils. Of the aliphatic hydrocarbons, branched hydrocarbons are preferred, particularly the Isopar™ series of isoparaffinic hydrocarbons (Exxon Chemical Co; Houston, Tex.).

The thermoplastic polymer particles of the toner are made from a polymer that includes mer units derived from one or more of ethylene, propylene, vinyl acetate, (meth)acrylic acid, an alkyl (meth)acrylate (e.g., ethyl acrylate, methyl methacrylate, butyl methacrylate, etc.), terephthalic acid, an alkyl terephthalate (e.g., butyl terephthalate), and the like. Preferred polymers are those that include mer units derived from ethylene and vinyl acetate (e.g., an ethylene/vinyl acetate copolymer).

The pigment of the toner can be a dye (i.e., a liquid pigment) or a particulate (i.e., a solid). Representative examples of the former include Monastral Blue B or G, Toluidine Red Y or B, Quindo Magenta, Monastral Green B or G, and the like, whereas representative examples of the latter include oxides of such metals as Fe, Co, Ni, etc., ferrites of such metals as Zn, Cd, Ba, Mg, etc., alloys, carbon black, and the like. Relative to the amount of polymer used, the amount of pigment can be about 10 to 35 weight percent for dyes or about 40 to 80 weight percent for particulates.

The charge directing compound of the toner can be a zwitterionic compound (e.g., lecithin) or an ionic compound (e.g., the metal salt of a long-chain organic acid or ester such as barium petronate). If desired, both types of charge directing compounds (i.e., zwitterionic and ionic) can be used together. Also, if desired, the charge directing compound can be used in conjunction with a polymer (e.g., polyvinylpyrrolidone) which assists in stabilizing the charge directing compound(s).

Generally, the toner composition is prepared sequentially, with polymer particle formation being followed by addition of the charge directing compound. The first step involves (1) mixing at an elevated temperature (e.g., 90° C.) the polymer (s) of choice with a plasticizer, which can be the same material later used as the nonpolar liquid or a different material, a pigment, and, optionally, a processing aid such as a wax until a homogeneous mixture is obtained; (2) cooling the mixture until it hardens and then slicing it into strips; and (3) in the nonpolar liquid, wet grinding the strips so as to form particles with fibrous appendages. The vast majority of the fiber-containing particles thus produced preferably have diameters that are no more than 1–2 μm. The polymer-nonpolar liquid mixture is diluted to the desired concentration (generally about 1.5% solids) by the addition of more nonpolar liquid.

The charge directing compound is diluted in a separate volume the nonpolar liquid, and this is added incrementally to a diluted slurry of the polymer particles in the nonpolar liquid until the desired conductivity is reached. This blend then can be used as the toner composition.

Preferred toners are those of the ElectroInk™ series of toners (Indigo Ltd.; Rehovot, Israel). Further details regarding the composition, individual components, and/or manufacture of these toners are believed to be given in, for example, the following U.S. patents, the teachings of which are incorporated herein by reference:

| | |
|---|---|
| 4,794,651 (Landa et al.) | 4,842,974 (Landa et al.) |
| 5,047,306 (Almog) | 5,047,307 (Landa et al.) |
| 5,192,638 (Landa et al.) | 5,208,130 (Almog et al.) |
| 5,225,306 (Almog et al.) | 5,264,313 (Landa et al.) |
| 5,266,435 (Almog) | 5,286,593 (Landa et al.) |

-continued

| | |
|---|---|
| 5,300,390 (Landa et al.) | 5,346,796 (Almog) |
| 5,554,476 (Landa et al.) | 5,407,771 (Landa et al.) |

Having described machines and processes useful in carrying out the present invention, attention now will be directed toward the print receiving medium, i.e., the film.

Films including one or more thermoplastic polymers are used throughout the packaging industry for a wide variety of purposes. Single-layer films are the simplest and, as the name implies, involve only a single polymeric layer.

More widely used, because of the tailored properties they afford, are films having two or more layers adhered or laminated to one other. Such multilayer films can include layers with high or low permeability to one or more gases (e.g., poly(vinylidene chloride) is known to provide a barrier to oxygen whereas poly(styrene butadiene) is known to have good oxygen permeability), layers including polymers with a high modulus of elasticity which provide strength, heat sealing layers, tie layers, and a wide variety of other layers that provide the multilayer film with one or more specialized properties. One or more layers of the film can include one or more adjuvants such as, for example, antiblocking agents, antifogging agents, pigments, antistatic agents, surfactants, and the like.

Regardless of whether the polymeric film is single-layer or multilayer, it can be supported on a sheet material as it passes through the printing press. (Many multilayer films are sufficiently strong that they do not require such additional support; however, the present invention is not limited to those films that possess such strength.) Useful sheet materials include other polymeric films, paper, fabrics, belts, foils, and the like. The polymeric film to which the printed image is applied can be adhered to the supporting sheet material.

As mentioned previously, polymeric films intended to be printed upon commonly have their surfaces treated so as to prime them for receiving ink. Typical oxidative treatments have included corona discharge treatment, flame treatment, and cool plasma treatment. Chemical treatment has involved the application of a distinct priming layer to the polymeric film prior to its being printed. Regardless of the type of treatment, it adds an extra, costly step to the printing process and can negatively impact other performance properties of the film.

Those skilled in the art heretofore have primed the surface of films to be electrostatically printed, and a whole industry has developed around the manufacture and supply of primed films. Nevertheless, research leading to the present invention has shown that certain films can be electrostatically printed without undergoing a priming step.

Conventional thinking has been that ink (i.e., toner) adhesion to film surfaces primarily is a function of surface tension (thus, the modification of the film surface via corona discharge or flame described above). Based on the research leading to the present invention, rheology of the polymer(s) in the surface layer of the film (i.e., the layer to receive the printed image) appears to be of at least equal importance.

In accordance with the present invention, an unprimed polymeric film can receive a polymeric film image (such as is produced by the electrostatic techniques described above) as long as the surface layer of the film includes one or more thermoplastic polymers that has a melting point of no more than about 130° C., preferably no more than about 125° C. Where the polymeric film is a multilayer film, the surface layer is that outer layer which ultimately receives the printed image; if both outer layers are to be printed upon, both are considered to be surface layers for purposes of the present invention.

Because the vast majority of polymers do not exhibit a sharp melting point (as do crystalline solids), certain protocols are accepted by those skilled in the art. For example, one common way to measure certain properties of a polymer is through the use of a differential scanning calorimeter (DSC). When analyzed in a DSC, many polymers display several peaks corresponding to different melting points or endothermic events. For the sake of convenience and clarity, the melting point of such a polymer is listed as the center of the highest such endotherm.

Thermoplastic polymers having melting points no more than about 130° C., preferably no more than about 125° C., include many polymers containing mer units derived from ethylene, propylene, and/or styrene. Those containing mer units derived from ethylene are particularly preferred. Representative examples of such polymers containing mer units derived from ethylene include, but are not limited to, ethylene/α-olefin copolymers, polyethylene homopolymer, LDPE, LLDPE, VLDPE, ULDPE, ethylene/cyclic olefin copolymers, ionomers, ethylene/vinyl acetate copolymers, ethylene/(meth)acrylate copolymers, and ethylene/(meth) acrylic acid copolymers. Representative examples of polymers containing mer units derived from propylene include, but are not limited to, syndiotactic polypropylene and propylene/α-olefin copolymers. Representative examples of polymers containing mer units derived from styrene include polystyrene (an amorphous polymer with no melting point), styrene block copolymers, and styrene/α-olefin copolymers. Other potentially useful polymers include copolyamides, certain copolyesters, polybutadiene, poly(vinyl chloride), and polybutene.

One hypothesis advanced to explain the results seen in the following examples is that the polymer in the surface layer of the polymeric film slightly deforms or flows when in contact with the blanket of the above-described press, which typically is maintained at a temperature of from about 120° to about 135° C. When the polymeric film image is transferred from the blanket to the polymeric film, the heat-softened surface layer readily accepts "lamination" of the polymeric film image.

Based on this hypothesis, one of ordinary skill in the art can see that the melting point of the polymer might not always be the critical factor. For example, especially with respect to amorphous polymers, glass transition temperature potentially is the critical factor. Alternatively, softening point of the polymer potentially is critical. Thus, those polymers with softening points below about 130° C., preferably no more than about 125° C., also are potentially useful in conjunction with the present invention. In cases of polymer blends, the softening point potentially can be a more convenient guide to utility than melting point. Nevertheless, experience has shown that, for most polymeric films, the melting point of the polymer(s) in the surface layer is a reliable indicator of whether it can be used in accordance with the present invention.

Based on the foregoing, one of ordinary skill in the art can see that placing a lower limit on the melting point of potentially useful polymers is problematical, if not counterproductive. For example, if the operating temperature of the blanket is reduced below its normal range (i.e., about 120°–135° C.), films having a surface layer including a polymer with a very low melting point—films that otherwise might become excessively tacky during the printing process—can become useful. As stated earlier, while not wishing to be unduly limited to a particular theory, themal properties are believed to play a significant role in determining which polymers can and cannot be used in conjunction with the present invention. In addition to melting point and glass transition temperature, molecular weight of the polymer influences rheology. For example, a low melting point polymer having a high molecular weight, or having been crosslinked, might be useful at higher blanket temperature settings. Nevertheless, polymers having melting points of at least about 65° C., preferably at least about 75° C., more preferably at least about 85° C., even more preferably at least about 90° C., are believed to be particularly useful.

In addition to discovering that certain polymeric films can be printed without any advance priming, the work leading to the present invention surprisingly has shown that such films also display a propensity to retain such images when heat treated. As mentioned previously, many polymeric films used in the packaging industry are heat shrunk (such as by, for example, being passed through a hot water or steam tunnel) prior to final use. Delamination of the image from the film has not been found to occur readily when the above-described process is followed. The fact that unprimed films can not only be printed, but also retain the printed image upon heat treatment, is an unexpected and significant advantage of the present invention.

Once printed, the polymeric film can be further processed. For example, one or more protective layers (i.e., an abuse layer) can be laminated (e.g., thermally or adhesively) to the printed polymeric film so as to create a trapped print product. Alternatively, one or more polymeric layers providing useful properties to the overall construction (e.g., an oxygen barrier layer) can be laminated to the printed polymeric film.

Also, if desired, the printed polymeric film can be converted (in-line or off-line) into a package by the creation of one or more closures. Where the printed film is in the form of a tube, only one bottom closure need be created or applied prior to create a pouch into which a given product can be placed. Where the printed film is not in the form of a tube, several closures can be applied so as to form packages having a variety of geometries. (For example, seals can be created by, for example, typical heat seal equipment while application of a clip or adhesive can provide alternate closure means.)

Aspects of this invention are further illustrated by the following examples. The particular materials and amounts thereof, as well as other conditions and details, recited in these examples should not be used to unduly limit this invention.

EXAMPLES

Several polymeric films were printed on an Indigo E-Print™ 1000 color press (a color press for the printing of paper, manufactured by Indigo Ltd.) according to the specifications provided with an Omnius™ color press (a color press for the printing of film) to simulate the printing process which occurs in the latter. The results for these films are set forth in Examples 1–4.

Thereafter, several unprimed polymeric films were printed in a similar fashion, this time on an Omnius™ color press, and the results for these films are set forth in Examples 5–14.

The performance of two multilayer tubing materials before and after post-printing heat treatment was measured, and the results are given in Examples 15–18.

Examples 1–4

Sheets from four films with varying surface tensions were run through an E-Print™ 1000 press in a manner that simulated the conditions experienced in an Omnius™ color press. Untreated films, as well as films having been primed with a Topaz™ primer (Indigo, Ltd.), were examined. Capacity of the films to receive a printed image, as well as the adherence of the printed image to those films, was determined.

The latter property was determined by applying, then removing, a strip of pressure sensitive adhesive (PSA) tape from the printed image and determining whether the image stayed on the film. Results are given below as "Good", "Poor", or "Fail".

In the table set forth below, the following polymeric films were tested both with and without primer:

1. EG™ polyethylene terephthalate (Ameritape, Inc.; North Bergen, N.J.)
2. Capran™ saran-coated nylon (Allied Signal, Inc.; Morristown, N.J.)
3. A Cryovac™ multilayer forming film having a polypropylene surface layer (W.R. Grace & Co.; Duncan, S.C.)
4. A Cryovac™ multilayer film having an outer layer of homogeneous ethylene/octene copolymer (W.R. Grace & Co.)

| Sample | Surface tension | Melting point of surface layer | Unprimed | | Primed | |
|---|---|---|---|---|---|---|
| No. | (dynes) | (° C.) | Printing | Adhesion | Printing | Adhesion |
| 1 | 54 | 265 | Poor | Fail | Good | Good |
| 2 | 38 | 225 | Poor | Fail | Good | Good |
| 3 | <32 | 161 | Fail | — | Poor | Fail |
| 4 | <32 | 100 | Good | Good | Good | Good |

As can be seen from the data of Table 1, the only unprimed film that passed the adhesion test was Example 4. Also, this data does not clearly establish a correlation between printability and surface tension.

Examples 5–14

Ten untreated (i.e., unprimed) films were run through an Omnius™ One Shot color press to determine printability. The films were 5. Escorene™ LD-318.92 ethylene/vinyl acetate copolymer (Exxon)
6. XU59220.01, a homogeneous ethylene/octene copolymer (Dow)
7. PE-1042CS5 low density polyethylene (Rexene Products; Dallas, Tex.)
8. Dowlex™ 2045.03 linear low density polyethylene (Dow)
9. Escorene™ PD-9302 propylene/ethylene copolymer (Exxon)
10. Escorene™ PD-3345 polypropylene (Exxon)
11. Affinity™ PL 1140 homogeneous polyethylene (Dow)
12. Affinity™ PL 1850 homogeneous polyethylene (Dow)
13. Escorene™ LD 409.09 low density polyethylene (Exxon)
14. Surlyn™ 1705 ionomer (DuPont de Nemours; Wilmington, Del.).

Capacity of the films to receive a printed image was determined with the results being reported below as "Pass" or "Fail". For those films that could be printed, their capacity to maintain adherence with the printed image (using the PSA tape test described in Examples 1–4) also was determined with the results being reported below as "Good", "Acceptable", or "Poor".

TABLE 2

| Sample No. | Melting point (° C.) | Printability | Adhesion |
|---|---|---|---|
| 5 | 98 | Pass | Poor |
| 6 | 100 | Pass | Acceptable |
| 7 | 112 | Pass | Poor |
| 8 | 123 | Pass | Poor |
| 9 | 139 | Fail | — |
| 10 | 161 | Fail | — |
| 11 | 102 | Pass | Good |
| 12 | 98 | Pass | Good |
| 13 | 112 | Pass | Poor |
| 14 | 98 | Pass | Good |

As can seen from the data of Table 2, those polymeric films with melting points less than about 130° C. could be printed upon, even in the absence of a chemical or oxidative priming step. Those with melting points above 130° C. could not be printed upon successfully.

No clear trend with respect to adhesion can be established from this data.

Examples 15–18

A Crupvac™ multilayer tubing material having a surface layer of homogeneous ethylene/octene copolymer with a melting point of 94° C. (W.R. Grace & Co.), was printed and then tested for ink adhesion (using the PSA tape tranfer test described in Examples 1–4) both before (Ex. 15) and after (Ex. 16) having passed through a 99° C. (210° F.) hot water tunnel at about 1.07 m/min (35 ft/min).

A Cryovac™ multilayer tubing having a surface layer including a blend of ethylene/vinyl acetate copolymer and LLDPE (W.R. Grace & Co.), also was printed and tested for ink adhesion both before (Ex. 17) and after (Ex. 18) having passed through the hot water tunnel in the manner set forth in the preceding paragraph.

Results are given below in Table 3, with adhesion of the image rated on a scale of "Poor", "Acceptable", "Good", and "Excellent".

TABLE 3

| Sample No. | Adhesion |
|---|---|
| 15 | Good |
| 16 | Excellent |
| 17 | Good |
| 18 | Excellent |

The results of Table 3 show that the adhesion of polymeric film images to polymeric films, suprisingly, can improve after the printed film is heat treated, such as would occur during heat shrinking of the film.

Various modifications and alterations that do not depart from the scope and spirit of this invention will become apparent to those skilled in the art. This invention is not to be unduly limited to the illustrative embodiments set forth herein.

I claim:

1. A printed thermoplastic packaging material comprising:

a) a flexible thermoplastic packaging film comprising a surface polymeric layer, optionally with one or more other layers laminated thereto, said surface polymeric layer comprising as its primary component a thermoplastic polymer having at least one of a melting point and Vicat softening point of no more than about 130° C; and b) on said surface polymeric layer, a printed image derived from a toner, said surface polymeric layer being chemically and oxidatively unprimed.

2. The printed flexible thermoplastic packaging material of claim 1 wherein said thermoplastic polymer has at least one of a melting point and Vicat softening point of no more than about 125° C.

3. The printed flexible thermoplastic packaging material of claim 1 wherein said thermoplastic polymer comprises mer units derived from ethylene.

4. The printed flexible thermoplastic packaging material of claim 1 wherein said thermoplastic packaging film is heat shrinkable.

5. The printed flexible thermoplastic packaging material of claim 1 wherein said substrate film, after being printed, is sealed so as to form a package.

6. The printed flexible thermoplastic packaging material of claim 1 wherein said thermoplastic polymer is a homogeneous polyethylene, a low density polyethylene, a linear low density polyethylene, very low density polyethylene, the metal salt of a polymer comprising mer units derived from ethylene and (meth)acrylic acid, or an ethylene/vinyl acetate copolymer.

7. The printed thermoplastic packaging material of claim 1 wherein said flexible packaging film comprises at least two layers.

8. A printed thermoplastic packaging material consisting essentially of:

a) a flexible thermoplastic packaging film comprising a surface polymeric layer, optionally with one or more other layers laminated thereto, said surface polymeric layer comprising as its primary component a thermoplastic polymer having at least one of a melting point and a Vicat softening point of no more than about 130° C; and b) on said surface polymeric layer, a printed image derived from a toner.

9. The printed flexible thermoplastic packaging material of claim 8 wherein said thermoplastic polymer has at least one of a melting point and a Vicat softening point of no more than about 125° C.

10. The printed flexible thermoplastic packaging material of claim 8 wherein said thermoplastic polymer comprises mer units derived from ethylene.

11. The printed flexible thermoplastic packaging material of claim 8 wherein said thermoplastic packaging film is heat shrinkable.

12. The printed flexible thermoplastic packaging material of claim 8 wherein said thermoplastic packaging film, after being printed, is sealed so as to form a package.

13. The printed thermoplastic packaging material of claim 8 wherein said flexible packaging film comprises at least two layers.

14. A process of making a printed flexible thermoplastic packaging material comprising the step of transferring a toner-derived image from a heated plate to a surface of a flexible thermoplastic packaging film, said thermoplastic packaging film comprising a surface polymeric layer, optionally with one or more other layers laminated thereto, said surface polymeric layer comprising as its primary component a thermoplastic polymer having at least one of a melting point and a Vicat softening point of no more than about 130° C., said surface polymeric layer being chemically and oxidatively unprimed.

15. The process of claim 14 wherein said thermoplastic polymer has at least one of a melting point and a Vicat softening point of no more than about 125° C.

16. The process of claim 14 wherein said image comprises a thermoplastic polymer which entraps one or more types of pigment.

17. The process of claim 14 wherein said toner comprises:

a) a non-polar liquid;

b) a thermoplastic polymer particle having a plurality of integral fibers extending therefrom, said fibers being capable of matting with like fibers of other like particles;

c) a charge director; and d) optionally, a compound to stabilize the electrical properties of said charge director.

18. The process of claim 17 wherein said thermoplastic polymer particle comprises a polymer comprising mer units derived from ethylene and, optionally, further comprising mer units derived from vinyl acetate.

19. The process of claim 14 wherein said thermoplastic polymer is a homogeneous polyethylene, a low density polyethylene, a linear low density polyethylene, very low density polyethylene, the metal salt of a polymer comprising mer units derived from ethylene and (meth)acrylic acid, or an ethylene/vinyl acetate copolymer.

20. The process of claim 14 wherein said polymeric film image is created by means of an electrostatic process.

* * * * *